US008579775B2

(12) United States Patent
Eun et al.

(10) Patent No.: US 8,579,775 B2
(45) Date of Patent: Nov. 12, 2013

(54) SUPPLY ROLLER OF DEVELOPING DEVICE FOR IMAGE FORMING APPARATUS AND METHOD OF MANUFACTURING THE SAME

(75) Inventors: Jong-moon Eun, Yongin-si (KR); Tae-hyun Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1376 days.

(21) Appl. No.: 11/701,383

(22) Filed: Feb. 2, 2007

(65) Prior Publication Data

US 2008/0047142 A1 Feb. 28, 2008

(30) Foreign Application Priority Data

Aug. 23, 2006 (KR) ..... 10-2006-0079806

(51) Int. Cl.
*G03G 15/08* (2006.01)

(52) U.S. Cl.
USPC ..... 492/53; 492/56

(58) Field of Classification Search
USPC ..... 492/17, 18, 20, 53, 56
See application file for complete search history.

(56) References Cited

U.S. PATENT DOCUMENTS 4,309,803 A * 1/1982 Blaszak ..... 492/53
5,386,279 A * 1/1995 Fukami et al. ..... 399/313
5,656,344 A * 8/1997 Sawa et al. ..... 428/36.5
5,822,658 A * 10/1998 Tanaka et al. ..... 399/174
5,834,116 A * 11/1998 Sawa et al. ..... 428/375
6,776,745 B2 * 8/2004 Nakashima et al. ..... 492/56
6,813,470 B1 * 11/2004 Elbert et al. ..... 399/381
2002/0091170 A1 7/2002 Sakata et al.
2003/0153444 A1 8/2003 Nakashima et al.
2004/0096247 A1 * 5/2004 Ki et al. ..... 399/286
2006/0130330 A1 6/2006 Kim
2007/0154240 A1 * 7/2007 Elbert et al. ..... 399/176

FOREIGN PATENT DOCUMENTS

CN 1434354 8/2003
EP 0 962 667 12/1999

* cited by examiner

*Primary Examiner* — David Bryant
*Assistant Examiner* — Christopher Besler
(74) *Attorney, Agent, or Firm* — Roylance, Abrams, Berdo & Goodman, L.L.P.

(57) ABSTRACT

A supply roller of a developing device for an image forming apparatus and a method of manufacturing the same are provided, which is small and exhibits excellent toner supply properties while preventing occurrence of the ghost phenomenon and toner-filming phenomenon, which cause a deterioration in image quality. The supply roller of the developing device for the image forming apparatus according to the present invention includes a shaft, and a conductive resilient member enclosing an outer circumference of the shaft. The conductive resilient member has a density of about 60 kg/m$^3$ to about 120 kg/m$^3$, and an outer diameter of about 8.0 mm to about 10.0 mm.

13 Claims, 1 Drawing Sheet

SUPPLY ROLLER OF DEVELOPING DEVICE FOR IMAGE FORMING APPARATUS AND METHOD OF MANUFACTURING THE SAME

CROSS-REFERENCE TO RELATED APPLICATION

This application claims the benefit under 35 U.S.C. §119 (a) of Korean Patent Application No. 10-2006-0079806, filed on Aug. 23, 2006, in the Korean Intellectual Property Office, the entire disclosure of which is hereby incorporated by reference in its entirety.

BACKGROUND OF THE INVENTION

1. Field of the Invention

The present invention relates to a supply roller of a developing device for an image forming apparatus, and to a method of manufacturing the supply roller. More particularly, the present invention relates to a supply roller of a developing device for an image forming apparatus, which is small and exhibits excellent toner supply properties while preventing occurrence of a ghost phenomenon and a toner-filming phenomenon which cause a deterioration in the image quality. The invention is further directed to a method of manufacturing the image forming apparatus and the supply roller.

2. Description of the Related Art

In image forming apparatuses, a latent image is formed on a photoreceptor using a light scanner, a toner is supplied from a developing device having toner composition to form an image, and the latent image is developed with toner to form an image. Image forming apparatuses comprise a plurality of rollers, which are necessary to perform various operations. Among these rollers, a supply roller supplies toner from the developing device to the other components such as the photoreceptor.

The general image forming operation in the image forming apparatus is described with reference to FIG. 1 as follows.

FIG. 1 is a view schematically illustrating a standard image forming apparatus.

First, a charging roller 16 charges a photoreceptor 11, and an electrostatic latent image to be developed is formed on the charged photoreceptor 11 by a laser scanning unit (LSU) 18.

A supply roller 13 supplies toner 14 from inside the developing device to a developing roller 12. The toner supplied to the developing roller 12 is thinned to a uniform thickness by a toner layer control apparatus 15, and at the same time is charged due to high friction caused by interaction between the developing roller 12 and the toner layer control apparatus 15.

When the toner passing through the toner layer control apparatus 15 comes into contact with the photoreceptor 11, the latent image formed on the photoreceptor 11 is developed. The developed toner is transferred onto print paper by a transfer roller 19, and then completely fixed onto the print paper so that an image is formed.

If the toner formed on the photoreceptor 11 remains after printing, the toner is cleaned by a cleaning blade 17. The toner separated from the photoreceptor 11 by the cleaning blade 17 is collected separately to be removed later.

The toner in the supply roller 13 in the image forming apparatus has a constant charge to mass ratio (Q/M) in association with the interaction between the developing roller 12 and the toner layer control apparatus 15. The supply roller 13 supplies the toner to the developing roller, and recovers remaining toner not used for the development of the latent image in the developing device.

The supply roller is usually formed from a polyurethane foam or silicone foam. Polyurethane foam has a lower hardness and price than silicone foam.

Recently, image forming apparatuses have been developed with reduced size, longer lifespan, low temperature fixing properties, and a capability of forming glossy images. In particular, color image forming apparatuses have been required to be increasingly miniaturized, because the color image forming apparatuses comprise developing devices containing different color toners.

However, in order to miniaturize the image forming apparatus, each constituent must be miniaturized, but problems arise when miniaturizing the supply roller. When the outer diameter of the supply roller is small, the toner supply properties are reduced and the ghost phenomenon and toner-filming phenomenon occur.

The ghost phenomenon is observed when toner is supplied by a small supply roller to cause unstable electrification of the toner, and as a result, a residual image is formed on the final image unintentionally.

Additionally, the toner-filming phenomenon means that a gap portion of the supply roller is filled with fine toner particles so that the supply roller has inferior supply properties. This problem caused by the toner-filming phenomenon stands out more clearly due to the miniaturization of the supply roller.

Therefore, supply rollers are required which can be manufactured in a small size in response to the need for the miniaturization of image forming apparatuses, and can overcome the above problems caused by miniaturization.

SUMMARY OF THE INVENTION

Exemplary embodiments of the present invention address at least the above problems and/or disadvantages and provide at least the advantages described below. Accordingly, an exemplary aspect of the present invention is to provide a supply roller of a developing device for an image forming apparatus, which is small and exhibits excellent toner supply properties while preventing the occurrence of the ghost phenomenon and toner-filming phenomenon that causes deterioration in image quality and the invention is also directed to a method of manufacturing the supply roller.

In order to achieve the above-described aspects of the present invention, a supply roller of a developing device for an image forming apparatus is provided, which includes a shaft; and a conductive resilient member enclosing an outer circumference of the shaft. The conductive resilient member has a density of about 60 $kg/m^3$ to 120 $kg/m^3$, and an outer diameter of about 8.0 mm to 10.0 mm.

In an exemplary implementation, the shaft has an outer diameter of about 4.0 mm to 6.0 mm.

Additionally, the conductive resilient member is formed from a composition which comprises a polyurethane, a conductive additive, a blowing agent, and a surfactant.

In an exemplary implementation, the polyurethane is prepared by reacting a polyol and a polyisocyanate in the presence of a catalyst. The catalyst is selected from among organometallic compounds, amine-based compounds, and mixtures thereof. In one embodiment, the monomer components are reacted in the presence of the catalyst and the blowing agent to form a polyurethane foam structure suitable for use in forming the supply roller of the invention.

In an exemplary implementation, the organometallic compounds used as a catalyst comprise at least one metal selected from the group consisting of tin, lead, iron, and titanium.

In an exemplary implementation, the amine-based compounds used as a catalyst comprise a tertiary amine.

In an exemplary implementation, the conductive additive of the conductive resilient member comprises a compound having a hydroxyl group on its end, and comprises a polyalkylene glycol.

Additionally, the polyalkylene glycol is selected from the group consisting of a polyethylene glycol, a polypropylene glycol, a polytetramethylene glycol, a polyethylene glycol-polypropylene glycol copolymer, a ring-opening adduct of bisphenol A ethylene oxide, and a ring-opening adduct of bisphenol A propylene oxide.

In an exemplary implementation, the polyalkylene glycol has a molecular weight of about 300 to about 3,000.

In an exemplary implementation, the conductive additive of the conductive resilient member further comprises at least one salt selected from among alkali metal salts and alkaline earth metal salts, in addition to the polyalkylene glycol. In an exemplary implementation, the blowing agent comprises either water or a halogenated alkane. One suitable halogenated alkane is trichlorofluoromethane. Typically the blowing agent is included in an amount to produce a polyurethane product having a density of about 60 kg/m$^3$ to 120 kg/m$^3$. In an exemplary implementation, a silicone surfactant is used as the surfactant.

According to one exemplary aspect of the present invention, a method of manufacturing a supply roller of a developing device for an image forming apparatus, the method comprises preparing a conductive resilient member from a composition comprising a polyurethane, a conductive additive, a blowing agent and a surfactant; cutting the resulting conductive resilient member into a cylindrical shape, forming a shaft-shaped hole in the center of the conductive resilient member; and pushing a shaft through the hole, and heating, and adhering the conductive resilient member and the shaft. The conductive resilient member has a density of about 60 kg/m$^3$ to 120 kg/m$^3$ and an outer diameter of about 8.0 mm to 10.0 mm.

In an exemplary implementation, the shaft has an outer diameter of about 4.0 mm to 6.0 mm.

These and other aspects of the invention will become apparent form the following detailed description of the invention which in conjunction with the annexed drawings disclose various embodiments of the invention.

BRIEF DESCRIPTION OF THE DRAWINGS

The above aspects and features of the present invention will be more apparent by describing certain exemplary embodiments of the present invention with reference to the accompanying drawings, in which.

DETAILED DESCRIPTION OF THE INVENTION

Certain exemplary embodiments of the present invention will now be described in greater detail with reference to the accompanying drawings.

The matters defined in the description such as a detailed construction and elements are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
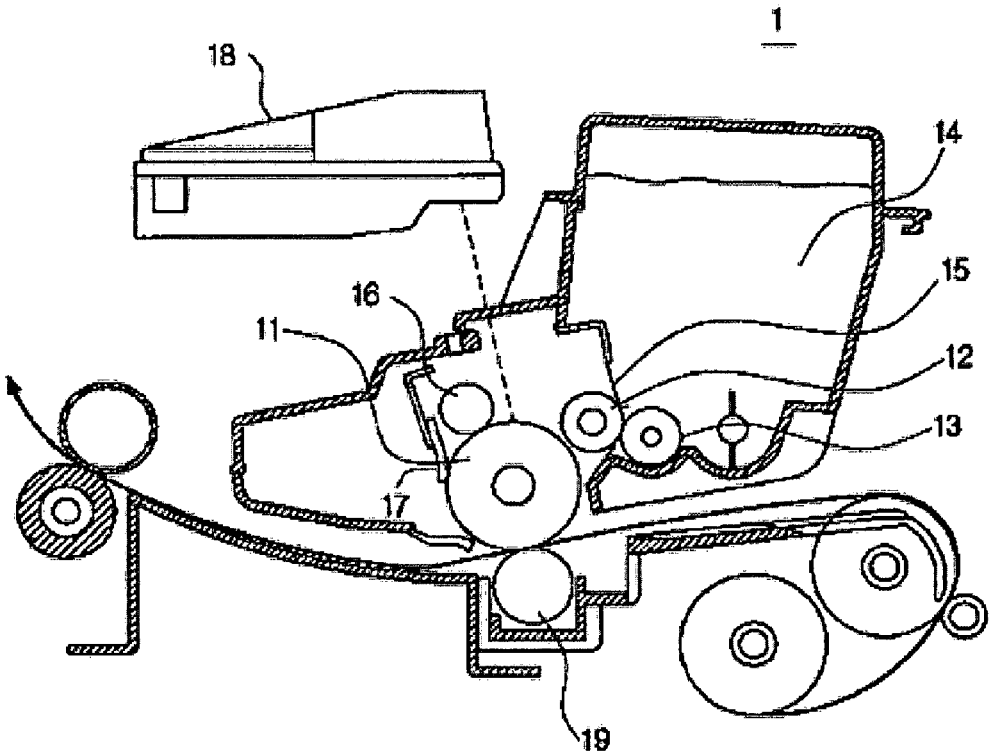
FIG. 1 (PRIOR ART)
FIG. 1 is a view schematically illustrating a general image forming apparatus.
Figure 2:
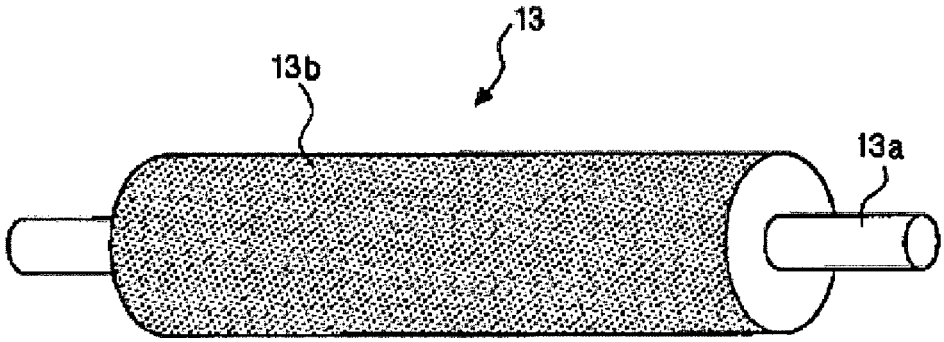
FIG. 2 is a perspective view illustrating a supply roller of a developing device usable in an image forming apparatus according to an exemplary embodiment of the present invention.

FIG. 2 is a perspective view illustrating a supply roller 13 of a developing device usable in an image forming apparatus according to an exemplary embodiment of the present invention. The supply roller 13 includes a shaft 13*a* and a conductive resilient member 13*b* enclosing an outer circumference of the shaft 13*a*.

The conductive resilient member 13*b* in one preferred embodiment has a density of about 60 kg/m$^3$ to 120 kg/m$^3$, and an outer diameter of about 8.0 mm to 10.0 mm.

The conductive resilient member 13*b* as prepared is formed or cut into a cylindrical shape to have a desired outer diameter. In order to insert the shaft 13*a* into the conductive resilient member 13*b*, a shaft-shaped hole is formed in the center of the conductive resilient member 13*b*. The shaft 13*a* desirably has an outer diameter of about 4.0 mm to 6.0 mm, and thus the shape of the hole should correspond to the outer diameter of the shaft 13*a*.

When the hole is formed, the shaft 13*a* is pushed into and through the conductive resilient member 13*b*, and the supply roller 13 is manufactured following predetermined steps.

The shaft 13*a* may be any shaft usable in manufacturing the roller, but desirably has an outer diameter of about 4.0 mm to 6.0 mm.

The shaft 13*a* is desirably made of metal, and metal alloy containing metals such as aluminum, iron and/or nickel.

The conductive resilient member 13*b* is formed from a molding composition which comprises a polyurethane, a conductive additive, a blowing agent, and a surfactant. In one embodiment of the invention the conductive resilient member is produced by molding a composition comprising polyurethane-forming monomer components, at least one conductive additive additive, a blowing agent and a surfactant. The composition is reacted to a polyurethane foam containing the conductive additive.

In this exemplary embodiment of the present invention, the polyurethane is obtained by mixing a compound containing at least two active hydrogens and a compound containing at least two isocyanate groups with additives in the presence of a catalyst, and a blowing, and curing the mixture to harden the composition and form the conductive resilient product.

For the compound containing the at least two active hydrogens, a polyol may be used. Examples of suitable polyols include a polyether polyol, a polyester polyol, and a polyetherester polyol having a terminal hydroxyl group on its end, but are not necessarily limited thereto. Additionally, a denatured polyol such as an acryl-denatured polyol or a silicone-denatured polyol can be used as the polyurethane used in the supply roller.

For the compound containing the at least two isocyanate groups, a polyisocyanate may be used. Examples of suitable polyisocyanates include toluene dilsocyanate (TDI), 4,4-diphenylmethane diisocyanate (MDI) and mixtures thereof, but are not necessarily limited thereto. Additionally, a denatured polyisocyanate can be used as the polyisocyanate.

The polyurethane is desirably prepared by reacting the polyol and the polyisocyanate in the presence of the catalyst. The catalyst is desirably selected from among organometallic compounds, amine-based compounds, and mixtures thereof.

The type and amount of the catalyst used are decided by taking into consideration the blowing properties, reaction time, increase in the ventilation rate of a polyurethane foam, and minimization of the density deviation.

The organometallic compounds used as the catalyst comprise at least one metal selected from the group consisting of tin, lead, iron, and titanium. It is preferable that the amine-based compounds used as the catalyst comprise a tertiary amine.

More desirably, the catalyst is selected from among a tertiary amine and a tin catalyst.

The conductive additive desirably comprises a compound having a terminal hydroxyl group on its end, and a polyalkylene glycol. In addition to the polyalkylene glycol, the conductive additive further comprises at least one salt selected from the group consisting of alkali metal salts and alkaline earth metal salts.

The polyalkylene glycol may comprise condensates of a linear or branched ethylene glycol, a propylene glycol, a tetramethylene glycol, 1,3-butadiol, 1,4-butadiol, neopentyl glycol, 1,6-hexanediol, and bisphenol A. In other words, the polyalkylene glycol may comprise a polyethylene glycol, a polypropylene glycol, a polytetramethylene glycol, a polyethylene glycol-polypropylene glycol copolymer, a ring-opening adduct of bisphenol A ethylene oxide, and a ring-opening adduct of bisphenol A propylene oxide.

Additionally, a polyester diol such as a polyadipate diol, a polycarbonate diol, and a polycaprolactone diol may be used as the compound having a hydroxyl group on its end.

The polyalkylene glycol or the polyalkylene diol desirably has a molecular weight of about 300 to 3,000. If the molecular weight is less than 300, the unreacted materials in the resulting polyurethane foam migrate to the surface, and if the molecular weight is equal to or higher than 3,000, the high viscosity of the polyalkylene glycol may inhibit the formation of the polyurethane foam.

The metal salts usable as the conductive additive according to the exemplary embodiment of the present invention may include perchlorate, chlorate, hydrochlorate, bromate, oxo acid salt, fluoroborate, sulfate, ethylsulfate, carboxylate, and sulfonate of the alkali metals and the alkaline earth metals, but are not necessarily limited thereto. Desirably, the metal salts may be lithium perchlorate.

Examples of the alkali metal salt are selected from the group consisting of lithium, sodium, potassium, rubidium, and cesium salts, but are not necessarily limited thereto. Desirably, lithium salts may be used.

Additionally, examples of the alkaline earth metal salts are selected from the group consisting of beryllium, magnesium, calcium, strontium, barium and radium salts, but are not necessarily limited thereto.

In the exemplary embodiments of the present invention, the amount of the conductive additive having a terminal hydroxyl group on its end to be added is about 3 phr (parts per hundred rubber) to about 100 phr based on the amount of the polyol. If the amount is equal to or lower than 3 phr, sufficient conductivity is not provided to the resulting polyurethane. If the amount is equal to or higher than 100 phr, the resulting polyurethane foam disintegrates and the cells are irregularly formed.

The blowing agent forms bubbles in the polyurethane, which helps to form the foam. The blowing agent usable in the exemplary embodiment of the present invention may comprise any blowing agent usable in blowing the polyurethane.

The blowing agent may be either water or a low-boiling point material such as a halogenated alkane. Examples of the halogenated alkane may include trichlorofluoromethane, but desirably water is used as the blowing agent.

The surfactant improves miscibility by reducing surface tension, causes the bubbles generated by the blowing agent to be of a uniform size, and stabilizes the blowing agent by controlling the cell structure of the polyurethane foam.

Desirably, a silicon surfactant can be used as the surfactant.

The surfactant is desirably added in an amount in the range of about 0.1 phr to about 5 phr based on the amount of polyol added in order to form the polyurethane. When the amount of the surfactant is equal to or less than 0.1 phr, the proper functioning of the surfactant cannot be guaranteed, and when the amount of the surfactant is equal to or higher than 5 phr, properties such as its compression set, may be reduced.

In the exemplary embodiments of the present invention, a method of manufacturing a supply roller of a developing device for an image forming apparatus comprises preparing a conductive resilient member comprising a polyurethane, a conductive additive, a blowing agent and a surfactant; cutting the conductive resilient member into a cylindrical shape, and forming a shaft-shaped hole in the center of the conductive resilient member; and pushing a shaft into and through the hole, heating, and adhering the conductive resilient member and the shaft.

The conductive resilient member prepared by the manufacturing method according to the exemplary embodiment of the present invention has a density of about 60 kg/m$^3$ to about 120 kg/m$^3$ and an outer diameter of about 8.0 mm to about 10.0 mm.

Additionally, the shaft has an outer diameter of about 4.0 mm to about 6.0 mm.

EXAMPLES

[Manufacture of Supply Roller]

First, a conductive resilient member was prepared. GP-3000 (manufactured by KOREA POLYOL Co., Ltd., containing 54 mgKOH/g of a hydroxy group) and KE-848 (manufactured by KOREA POLYOL Co., Ltd, containing 30 mgKOH/g of a hydroxyl group) as a polyester polyol, were combined with water as a blowing agent, a silicone surfactant as a surfactant, a catalyst, and a compound containing polyethylene glycol and lithium perchlorate as a conductive additive having a terminal hydroxyl group on its end, to obtain a pre-mixed polyol.

The conductive additive having a terminal hydroxyl group on its end was obtained in the following manner. To a methyl ethyl ketone solvent, were added 100 g of a polyethylene glycol having a molecular weight of 500 and 10 g of lithium perchlorate, and the resulting mixture was reacted at a temperature of 50° C. to 80° C. for 16 to 20 hours. This reaction was monitored using a Fourier Transform-Infrared Spectroscope (FT-IR), and the methyl ethyl ketone solvent was distilled off under a reduced pressure of 30 to 5 mmHg to obtain a conductive additive.

Toluene diisocyanate (TDI) as a polyisocyanate was added to the prepared pre-mixed polyol, and then agitated at 2000 rpm. The resulting mixture was injected into a mold, and then dried in a forced air convection oven at 60° C. for 20 minutes to prepare a conductive resilient member.

The prepared conductive resilient member was cut into a cylindrical shape, and a shaft-shaped hole was then formed longitudinally in the center of the cylindrical column. A metal shaft, wound with a hot melt sheet, was pushed into the hole. The conductive resilient member and the shaft were attached to each other by heating in a forced air convection oven at 120° C. for 30 minutes. The adhered conductive resilient member was polished by a polisher, and both ends of the conductive resilient member were then cut. By this process, a supply roller was manufactured.

Example 1

A supply roller was prepared in the supply roller manufacturing method described above, using the following quantities of each component.

| Composition | | Content (phr) |
|---|---|---|
| Polyol: | GP-3000 (manufactured by KOREA POLYOL Co., Ltd.) | 80.0 |
| | KE-848 (manufactured by KOREA POLYOL Co., Ltd.) | 20.0 |
| Polyisocyanate: TDI | | 105.0 |
| Catalyst: | Stannous octoate | 0.3 |
| | Triethylamine | 0.2 |
| Blowing agent: Water | | 4.0 |
| Surfactant: Silicone surfactant | | 1.5 |
| Conductive additive | | 35.0 |

The volume resistance and density of the supply roller manufactured in Example 1 were measured as follows.

(1) Resistance: the supply roller was mounted in a Jig, conductive shafts of 200 g were put on both ends of an upper part of the supply roller, −100 V of a direct current (DC) voltage was applied to the shaft, and the roller was rotated at a certain speed (for example, 30 rpm) to measure the electric current. The measured current value was converted to a resistance value using the following Equation.

$$\text{Resistance } (\Omega) = \text{Voltage (V)} / \text{Electric current (A)}$$

(2) Density: the weight of the conductive resilient member having a width of 300 mm, a length of 300 mm, and a thickness of 50 mm was measured.

$$\text{Density } (kg/m^3) = \text{Weight (kg)} / \text{Volume } (m^3)$$

The supply roller manufactured in Example 1 had a volume resistance of 0.5 MΩ and a density of 100 kg/m$^3$.

[Evaluation]

Supply rollers were manufactured by changing the outer diameter of the supply roller, the outer diameter of the shaft and the density of the conductive resilient member, and images were formed using each of the manufactured supply rollers to measure image quality.

(1) Outer Diameter of Supply Roller

When a supply roller having a volume resistance of 0.5 MΩ was manufactured in which the density of the conductive resilient member was 100 kg/m$^3$ and the outer diameter of the shaft was 6.0 mm, the outer diameter of the supply roller was changed to 7.0 mm, 8.0 mm, 9.0 mm, 10.0 mm, and 12.0 mm to measure image quality.

When the supply properties of the supply roller and the ghost phenomenon occurring on images were evaluated by the naked eye as the criteria for the image quality, the results were recorded using ○ to represent "Excellent", Δ to represent "Good", and × to represent "Poor." A toner was inserted into a gap of the conductive resilient member to block the gap when printing images for a long time period, so that the supply properties of the supply roller were reduced. The ghost phenomenon occurs when a residual image is generated on a formed image due to a difference in the charge amount of the toner. Accordingly, the image quality was evaluated by the naked eye by determining whether the ghost phenomenon occurred or whether the supply properties were reduced.

The results of the evaluation are shown in Table 1.

TABLE 1

| | Outer diameter (mm) | | | | |
|---|---|---|---|---|---|
| | 7.0 | 8.0 | 9.0 | 10.0 | 12.0 |
| Supply properties | X | Δ | Δ | ○ | Δ |
| Ghost phenomenon | X | ○ | ○ | ○ | ○ |

(2) Outer Diameter of Shaft

When a supply roller having a volume resistance of 0.5 MΩ and an outer diameter of 9.0 mm was manufactured, in which the conductive resilient member had the density of 100 kg/m$^3$, shafts with an outer diameter of 3.0 mm, 4.0 mm, 5.0 mm, 6.0 mm, and 7.0 mm were used to measure the image quality.

When the supply properties of the supply roller and the ghost phenomenon occurring on images were evaluated by the naked eye as the criteria for the image quality, the results were recorded using ○ to represent "Excellent", Δ to represent "Good", and × to represent "Poor." The results of the evaluation are shown in Table 2.

TABLE 2

| | Outer diameter (mm) | | | | |
|---|---|---|---|---|---|
| | 3.0 | 4.0 | 5.0 | 6.0 | 7.0 |
| Supply properties | X | ○ | ○ | Δ | X |
| Ghost phenomenon | X | ○ | ○ | ○ | ○ |

(3) Density of Conductive Resilient Member

When a supply roller having a volume resistance of 0.5 MΩ was manufactured to have a shaft with an outer diameter of 6.0 mm, and a supply roller with an outer diameter of 9.0 mm, the density of the conductive resilient member was set at 40 kg/m$^3$, 60 kg/m$^3$, 80 kg/m$^3$, 100 kg/m$^3$, 120 kg/m$^3$, and 140 kg/m$^3$ using a method such as changing the content of the composition, and the image quality was then measured. In order to change the density, a method was used in which the contents of a polyol and a polyisocyanate were changed, or an amount of the mixture injected into a mold was varied while maintaining the ratio of the total content of the composition.

When the supply properties of the supply roller and the ghost phenomenon occurring on images were evaluated by the naked eye as the criteria for the image quality, the results were recorded using ○ to represent "Excellent", Δ to represent "Good", and × to represent "Poor." The results of the evaluation are shown in Table 3.

TABLE 3

| | Density (kg/m$^3$) | | | | | |
|---|---|---|---|---|---|---|
| | 40 | 60 | 80 | 100 | 120 | 140 |
| Supply properties | ○ | ○ | Δ | Δ | Δ | X |
| Ghost phenomenon | X | Δ | Δ | ○ | ○ | ○ |

Referring to Table 1, a greater outer diameter of the supply roller corresponded to superior supply properties and prevention of the ghost phenomenon. However, if the outer diameter of the supply roller is too large, it is difficult to miniaturize the image forming apparatus.

Accordingly, when the outer diameter of the supply roller was 7.0 mm, the supply properties were reduced and the ghost phenomenon was obvious. When the outer diameter of the supply roller was 12.0 mm, the ghost phenomenon was less obvious. The ghost phenomenon occurred due to a difference in the charge amount of the toner by increasing the nip portion between the developing roller and the supply roller to increase the toner stress. The increased nip portion allowed the load of a toner cartridge to be increased, resulting in image deviations caused by such factors as jitter. Additionally, as it is necessary to miniaturize the image forming apparatus, particularly the developing device, high quality images can be formed using a small supply roller having an outer diameter of 8.0 mm to 10.0 mm.

Referring to Table 2, when the outer diameter of the shaft was 3.0 mm, the quality of the formed image was reduced when the above test was observed. In this case, the diameter of the shaft was very small, the shaft was bent, and thus the toner supply properties were reduced and the ghost phenomenon was obvious.

However, when the outer diameter of the shaft was in the range of 4.0 mm to 5.0 mm, the quality of the formed image was excellent as observed in the above test. When the outer diameter of the shaft was in the range of more than 6.0 mm to 7.0 mm, the outer diameter of the shaft was increased to reduce the thickness of the conductive resilient member because the outer diameter of the supply roller remained constant. Accordingly, the toner supply properties were reduced due to the occurrence of the toner filming phenomenon. Therefore, when the outer diameter of the supply roller remained constant, it was most desirable that the outer diameter of the shaft was in the range of 4.0 mm to 6.0 mm.

Referring to Table 3, when the conductive resilient member had a density of 40 kg/m$^3$, the image quality was reduced due to the ghost phenomenon occurring on images. When the conductive resilient member had a density of 140 kg/m$^3$, the supply properties were reduced due to the occurrence of the toner filming phenomenon. Therefore, it was most suitable that the density of the conductive resilient member was in the range of 60 kg/m$^3$ to 120 kg/m$^3$.

As described above, the exemplary embodiments of the present invention provide a supply roller of a developing device for an image forming apparatus, which can be manufactured in a compact size and which exhibits excellent toner supply properties while preventing occurrence of ghost phenomenon and toner-filming phenomenon causing deterioration in image quality.

Additionally, since the toner-filming phenomenon is prevented, the lifespan of the supply roller can be guaranteed to be longer.

The foregoing embodiments and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A supply roller of a developing device for an image forming apparatus, comprising:

a shaft having an outer diameter of about 4.0 mm to about 6.0 mm; and a conductive resilient member enclosing an outer circumference of the shaft, wherein the conductive resilient member has a density of about 80 kg/m$^3$ to about 120 kg/m$^3$, and an outer diameter of 8.0 mm to less than 10.0 mm, said conductive resilient member being obtained from a polyurethane, a conductive additive having a terminal hydroxyl group, a blowing agent, and a silicone surfactant, wherein the conductive additive comprises a polyalkylene glycol having a molecular weight of 300 to 3,000, wherein the polyurethane is prepared by reacting a polyol and a polyisocycanate in the presence of a catalyst.

2. The supply roller as claimed in claim 1, wherein the catalyst is selected from the group consisting of organometallic compounds, amine-based compounds, and mixtures thereof.

3. The supply roller as claimed in claim 2, wherein the organometallic compounds comprise at least one metal selected from the group consisting of tin, lead, iron, and titanium.

4. The supply roller as claimed in claim 2, wherein the amine-based compounds comprise a tertiary amine.

5. The supply roller as claimed in claim 1, wherein the polyalkylene glycol is selected from the group consisting of a polyethylene glycol, a polypropylene glycol, a polytetramethylene glycol, a polyethylene glycol-polypropylene glycol copolymer, a ring-opening adduct of bisphenol A ethylene oxide, and a ring-opening adduct of bisphenol A propylene oxide.

6. The supply roller as claimed in claim 1, wherein the conductive additive of the conductive resilient member further comprises at least one salt selected from the group consisting of alkali metal salts and alkaline earth metal salts.

7. The supply roller as claimed in claim 1, wherein the blowing agent comprises water or a halogenated alkane.

8. The supply roller as claimed in claim 7, wherein the halogenated alkane is trichlorofluoromethane.

9. A supply roller for a developing device for an image forming apparatus, the supply roller comprising:

a shaft having an outer diameter of about 4.0 mm to about 6.0 mm; and a cylindrical conductive resilient member on an outer circumference of the shaft, wherein the conductive resilient member is produced from a polymerizable composition including at least one polyol monomer component, a poly diisocyanate, a surfactant, a blowing agent and a conductive additive comprising a polyalkylene glycol having a molecular weight of about 300 to 3,000, and wherein said conductive resilient member has a density of about 80 kg/m$^3$ to about 120 kg/m$^3$, and an outer diameter of about 8.0 mm to about 10.0 mm.

10. The supply roller of claim 9, wherein said polymerizable composition further comprises a catalyst selected from the group consisting of organometallic compounds, amine-based compounds, and mixtures thereof.

11. The supply roller of claim 1, wherein the conductive additive comprises an alkali metal salt of an alkaline earth metal salt selected from the group consisting of perchlorates, chlorate, hydrochlorate, bromate, oxo acid salt, fluoroborate, sulfate, ethylsulfate, carboxylate and sulfonate.

12. The supply roller of claim 11, wherein said polyurethane is obtained from a polyol and a diisocyanate, and said polyalkylene glycol is present in amounts of about 3 phr to about 100 phr based on the amount of polyol.

13. The supply roller of claim 12, wherein said polyol is selected from the group consisting of polyetherpolyol, polyester polyol and polyester ether polyol.

* * * * *